US006199619B1

(12) United States Patent
Andersen

(10) Patent No.: US 6,199,619 B1
(45) Date of Patent: Mar. 13, 2001

(54) ARRANGEMENT OF AN INGATE SYSTEM WITH FEEDING RESERVOIR FOR FEEDING CASTINGS, AND A METHOD OF MAKING SUCH A SYSTEM

(75) Inventor: Uffe Andersen, Skævinge (DK)

(73) Assignee: Georg Fischer Disa A/S, Herlev (DK)

( * ) Notice: Subject to any disclaimer, the term of this patent is extended or adjusted under 35 U.S.C. 154(b) by 0 days.

(21) Appl. No.: 09/171,905

(22) PCT Filed: Aug. 19, 1996

(86) PCT No.: PCT/DK96/00349

§ 371 Date: Oct. 28, 1998

§ 102(e) Date: Oct. 28, 1998

(87) PCT Pub. No.: WO97/40952

PCT Pub. Date: Nov. 6, 1997

(30) Foreign Application Priority Data

May 1, 1996 (DK) ..... 0520/96

(51) Int. Cl.[7] ..... B22D 39/00; B22C 9/08

(52) U.S. Cl. ..... 164/133; 164/134; 164/358; 164/362; 164/363; 164/337

(58) Field of Search ..... 164/133, 358, 164/363, 364, 337, 167, 359, 362, 360, 134

(56) References Cited

U.S. PATENT DOCUMENTS

| | | | | |
|---|---|---|---|---|
| 1,410,775 | | 3/1922 | Thomas | 164/359 |
| 2,568,428 | | 9/1951 | Billiar | 164/359 |
| 4,913,218 | * | 4/1990 | Seidinger | 164/358 |
| 5,836,373 | * | 11/1998 | Hansen et al. | 164/167 |

FOREIGN PATENT DOCUMENTS

| | | | | |
|---|---|---|---|---|
| 748020 | | 3/1944 | (DE) . | |
| 24 46 554 | | 4/1975 | (DE) . | |
| 1 457 436 | | 12/1976 | (GB) . | |
| 2185203 | * | 7/1987 | (GB) | 164/358 |
| 63-43740 | * | 2/1988 | (JP) | 164/358 |
| 63-52744 | * | 3/1988 | (JP) | 164/358 |
| 1720782 | * | 3/1992 | (SU) | 164/358 |
| 95/18689 | * | 7/1995 | (WO) . | |

* cited by examiner

*Primary Examiner*—Harold Pyon
*Assistant Examiner*—I.-H. Lin
(74) *Attorney, Agent, or Firm*—Larson & Taylor PLC

(57) ABSTRACT

In an arrangement of an ingate system with feeding reservoir for feeding castings, preferably in moulds with pouring form the bottom (ascending casting), with which ingate system at least a feeding reservoir is connected. The ingate system is connected to one or a number of mould cavities least one feeding reservoir (7) is provided consituting a widened part of a duct (4) or a part of a duct in the ingate system (1), and that a partition (6) consisting of a gauze screen (6) or equivalent is provided separating the feeding reservoir (7) and the duct (4).

9 Claims, 1 Drawing Sheet

ARRANGEMENT OF AN INGATE SYSTEM WITH FEEDING RESERVOIR FOR FEEDING CASTINGS, AND A METHOD OF MAKING SUCH A SYSTEM

CROSS REFERENCE TO RELATED APPLICATION

This application is a 371 of PCT/OK 96/00349 filed Aug. 19 ,1996.

TECHNICAL FIELD

The invention relates to an arrangement of an ingate system with a feeding reservoir for feeding castings.

BACKGROUND ART

It is commonly known that metals, both in the liquid and the solid state, when cooled undergo a reduction in volume, a so-called thermal contraction. In casting moulds, in which a non-uniform heat distribution reigns in the mould cavity after the pouring, and in which for this reason all parts of the casting do not solidify at the same time, this causes the parts of the casting solidifying last to give off liquid metal to compensate for the contraction of the parts of the casting having solidified earlier, leading to faults in the casting, commonly called "shrinkage holes" appearing in the form of depressions in the surface of the casting or cavities (macroscopic or microscopic holes) within the casting. In order to avoid these casting faults, the skilled person can have recourse to a series of expedients, of which the most common is the use of feeding reservoirs, i.e. cavities in the mould being filled with metal during the pouring and having such dimensions that the metal in them solidifies later than the parts of the casting solidifying last, being connected to the latter through ducts having a relatively large cross-sectional area, thus being able to post-feed these parts with liquid metal to compangate for the contraction. U.S. Pat. No. 1,410,775 describas an example of this method.

In the method described in U.S. Pat. No. 1,410,775, the full flow of the melt passes through the feeding reservoir. As the latter will necessarily have a considerable volume in order to be able to accommodate all the melt required for feeding, this means that the melt will flow through the feeding reservoir in a turbulent manner. If the melt is of an easily oxidizable material, such as aluminium or maqnesium or their alloys, such an arrangement entails the risk of relatively large quantities of oxide being formed, causing a loss of metal and possibly contamination of the castings.

DISCLOSURE OF THE INVENTION

It is the object of the invention to provide an arrangement of an ingate system that does not present the disadvantages of the prior art referred to above, and according to the invention, this object is achieved by the features set forth hereinafter.

With this arrangement, the feeding reservoir is separated from the duct carrying the flow of melt by a permeable partition having a finite resistance to flow through it, and during the initial phase of the pouring, this partition will act like a wall restricting the flow to the duct only. If the latter is shaped in a manner supporting laminar or quasi-laminar flow, i.e. with a high ratio of circumference to cross-sectional area, such as a flat shape, then the risk of oxidization can be considerably reduced. During the later phases of the pouring, the back pressure from the casting cavity increases, causing melt in the duct to penetrate the permeable partition so as to gradually fill the feeding reservoir, and when the casting cavity is full, the reservoir will also be full and ready to supply feeding melt during the contraction of the casting in the cavity.

An additional advantage of using the permeable partition is that it has a braking effect upon the hydraulic surge occurring when the mould is full.

The present invention also relates to a method of making the arrangement of the invention.

Advantageous embodiments of the arrrangement and the method according to the invention, the effects of which—beyond what is obvious—are explained in the following detailed part of the present description, are set forth.

DESCRIPTION OF THE PREFERRED EMBODIMENT

Figure 1:
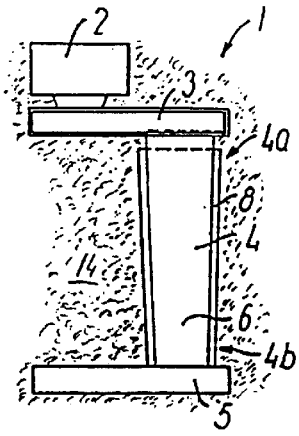
FIG. 1 shows a front view of the ingate system according to the invention.
Figure 3:
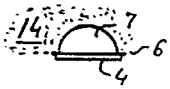
FIG. 3 shows a top view in cross-section of the downsprue according to the invention with feeding reservoir, gauze screen and downsprue, FIG. 4 in cross-section and at an enlarged scale shows the downsprue with an insulating layer around the feeding reservoir shown in FIG. 3.
Figure 4:
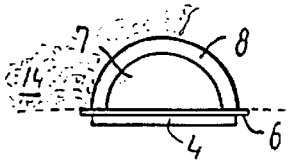
FIG. 4*a* is a cross-section of the downsprue at an enlarged scale, in which the gauze screen surrounds the downsprue.
FIG. 4*b* is a cross-section of the downsprue at an enlarged scale, in which the gauze screen forms the downsprue within the feeding reservoir.

FIG. 1 shows an ingate system 1 consisting of a pouring cup 2, a melt runner 3, a downsprue 4 and an ingate 5. In this inqate system, a melt runner 3 is placed downstream of the pouring cup in order to ensure that the melt will not be poured directly down into the downsprue 4, so that the melt will arrive in a calm state at the entrance to the downsprue 4, in the drawing being shown extending vertically. Then, the melt flows from the downsprue top 4*a* to the downsprue bottom 4*b*. In the embodiment shown, the downsprue 4 is shaped like a flat duct which, as will be seen from FIGS. 3 and 4, converges downwardly. The flat-duct shape of the downsprue 4 ensures a small hydraulic radius according to the formula:

$$r = \frac{A}{P},$$

in which A means the cross-sectional area,

P means the wetted circumference.

This hydraulic radius enters into the computation of Reynolds number according to the formula:

$$R = \frac{V_m \cdot r}{\mu}$$

in which $V_m$ means average flow velocity of the liquid, r means the hydraulic radius, $\mu$ means dynamic viscosity.

Thus, the flat shape contributes to provide a small Reynolds number, because in a flat duct, the wetted circumference is largest relative to the cross-sectional area. Thus, the inlet velocity $V_m$ may be increased for a corresponding cross-sectional area relative to a round inlet, so that a small Reynolds number is maintained. It is advantageous to keep the Reynolds number small, as this number indicates the transition from laminary flow (small number) to turbulent flow (largo number). With this flat shape, the flow in the downsprue 4 can take place mainly in a laminar fashion without turbulence.

The shape of the downsprue 4, converging downwardly towards the bottom 4*b*, ensures that low pressure does not arise in the top 4*a* of the downsprue 4, especially during the initial phase of the pouring of the melt, as a correctly converging shape ensures the same static pressure at the top 4*a* as at the bottom 4*b* according to Bernoulli's equation:

$$\frac{v^2}{2g} + \frac{p}{g\|} + h = const.$$

or $$\frac{V_1^2}{2g} + \frac{p_1}{g\|} + h_1 = \frac{V_2^2}{2g} + \frac{p_2}{g\|} + h_2 = const.$$

in which v means flow velocity of liquid, g means the acceleration of gravity, p means static pressure,

|| means specific gravity of the liquid, h means geodetic height, $X_1$ means top, $X_2$ means bottom.

A non-convergent downsprue 4 would cause the "pull" from the melt column to provide a lower pressure at the top 4*a* than at the bottom 4*b*, as will also be evident from Bernoulli's equation when the velocity v is the same and the heights h are different, this especially being the case in the initial phase of the pouring of the melt, there being no back pressure from melt in the mould cavity 15 capable of acting in the opposite direction through the ingate system 1. Thus, with this converging shape of the downsprue 4, commonly known by persons skilled within this art, it is possible to ensure uniform pressure throughout the downsprue 4, when the latter is shaped in consideration of Bernoulli's equations, so that the velocities v and the heights h are different, while the pressure p is the same. The laminar flows are ensured by at the same time providing such a geometrical shape that Reynolds number is held at a low value.

As shown in FIGS. 1–4*b*, at least one side of the downsprue 4 communicates through a gauze screen 6 with a feeding reservoir 7. The gauze screen 6 is permeable to the melt, but offers resistance against such penetration. When, in the initial phase of the pouring, a uniform pressure is being built up in the downsprue 4, this pressure also reigning in the feeding reservoir 7, the gauze screen 6 will, because of its resistance to flow through it, act in the manner of an ordinary duct wall. For this reason, the melt flows mainly in the downsprue 4 and does not to any significant extent penetrate into the feeding reservoir 7. The feeding reservoir 7 is, however, heated, at least with radiant heat from the melt flowing through the downsprue 4. As the melt in the mould cavity 15 gradually builds up a back pressure in the downsprue bottom 4*b*, the pressure in the latter will rise. The gauze screen 6 will, however, allow melt to penetrate in through the gauze screen 6 to the feeding reservoir 7, in which a process of slow filling is initiated. This will continue, the gauze screen 6 still, however, offering resistance against penetration by the melt. When after this, the mould cavity 15 is being filled with melt right up to the top, the liquid flow through the downsprue 4 ceases, and the full pressure from the melt being poured is now applied via the gauze screen 6 to the reservoir 7, which after this is filled quickly.

Figure 6:
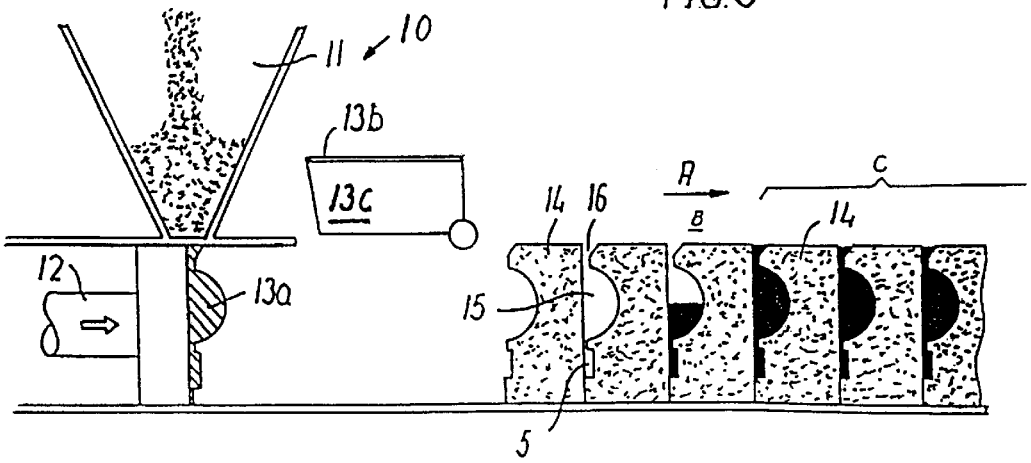
FIG. 6 shows a string-mould plant, in which the ingate system according to the invention can be used, and serves to illustrate the process.

After this, the pouring in the pouring station, indicated with B in FIG. 6, ceases, and if the mould is a mould 14 in a string of moulds, it can pass on in the direction of the arrow A to the cooling zone C.

In the cooling zone C, the casting contracts during solidification in the mould cavity 15 resulting in a fall of pressure in the ingate system 1, causing melt to be drawn from the feeding reservoir 7 to fill the cavities produced by the contraction in the mould cavity 15.

Figure 5:
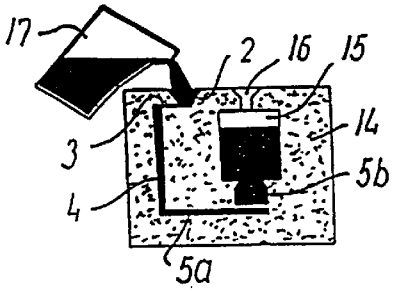
FIG. 5 shows an example of pouring when using an ingate system according to the invention as viewed in section through a mould.

FIG. 5 shows a mould with a bottom inlet comprising an inlet duct 5*a* and an ingate 5*b*, using an ingate system 1 according to the invention as described. When melt is poured from a pouring device 17 into the pouring cup 2, the melt will flow on via the ingate system 1 to the mould cavity 15, through which the melt will rise. In FIG. 5, the mould cavity 15 is shown as terminated upwardly by a riser 16. The riser 16 is, however, not necessary for the invention.

The mould 14 can be a mould in a string of moulds having been produced in a moulding machine 10, in which mould sand from a supply reservoir 11 is directed into a moulding space, in which patterns 13*a*, 13*b* on a hydraulic piston 12 and a counter-pressure plate 13*c*, respectively, are pressed against each other so as to form a mould 14, the latter then being pushed out into the string of moulds by the hydraulic piston 12 so as to form a part of the string of moulds. The mould is pushed further to a pouring station B, in which the mould cavity is filled with melt. After this, the mould 14 is moved further in the direction of the arrow A to a cooling section C, in which the melt solidifies and the casting contracts.

Figure 2:
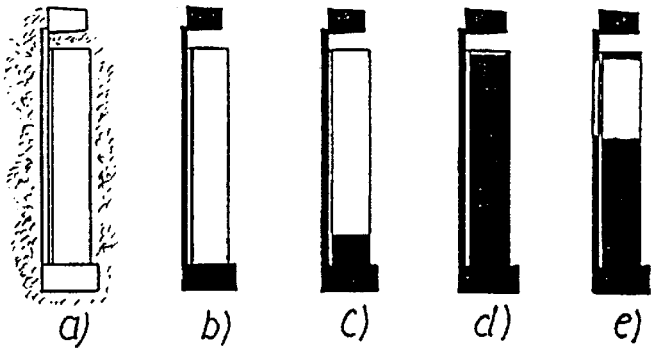
FIG. 2 shows side views of the ingate system according to the invention in various degrees of filling.

The course of events in the ingate system 1 during this casting process, e.g. in a moulding plant as shown in FIG. 6, is shown in FIG. 2 with FIGS. 2*b*–2*c*. Of these, FIG. 2*b* shows the initial phase of the pouring, during which the ingate system has just been filled up, and FIG. 2*c* shows the situation, in which the back pressure from the melt in the mould cavity 15 causes melt to penetrate into the feeding reservoir 7. When the hydraulic pouring surge occurs as a result of the mould cavity being completely filled, the feeding reservoir is substantially completely filled as shown in FIG. 2*d*. When after this the casting contracts, melt will be drawn from the feeding reservoir 7 as indicated in FIG. 2*e*.

When moulds are being produced in a moulding plant of the kind shown in FIG. 6, the feeding reservoir 7 and the gauze screen 6 can advantageously be manufactured and inserted in the form of a pre-fabricated integrated unit, possibly being insulated with an insulating tube 8, a so-called Iso-tube. Iso-tubes are insulating tubes being used in foundry practice to reduce the heat loss from feeding reservoirs. The tubes are produced in many different diameters and lengths. The material used can be "Keruld" and consists of ceramic fibres. In Denmark, the tubes are manufactured by the firm Keramax A/S, but are internationally better known as being supplied by the firm FOSECO.

The gauze screen can e.g. be produced from a material consisting of quartz glass in thin fibres, assembled to form a web with square holes bonded with a resin. This web is produced in three qualities, viz. soft, semi-rigid and rigid. The web being sold in the West under the name Firam can be procured by the meter with a width of 900 mm. Suppliers are the firm NOVACAST by Rudolf Silen and the firm Edstraco, and a corresponding product is marketed by the firm SENSANA.

The gauze screen may, of course, also be manufactured from other materials that are heat-resistant, e.g. ordinary glass-fibre web.

The permeable wall may be in other forms than a gauze screen; it may e.g. be in the form of a perforated plate, a grate, a sieve or screen etc., e.g. perforations in an Iso-tube.

The shape of the duct, in which the feeding reservoir 7 and the gauze screen 6 are situated, may, of course, differ from that shown. It can e.g. be a more or less horizontal channel or duct, in which the gauze screen 6 constitutes the upper side. The downsprue 4 may, of course, also be a duct constituting the inlet in a topingate system.

Further, the downsprue 4 and the feeding reservoir 7 as such may also be shaped differently, but Reynolds number should be taken into consideration when necessary with regard to the type of flow with a given alloy, and also Bernoulli's equation, when low pressure in the duct system is to be avoided.

Figure 4A:
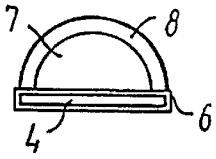

FIG. 4*a* shows an embodiment in which the gauze screen 6 surrounds the downsprue 4. With this arrangement, one side of the gauze screen 6 functions as a permeable wall, while its remaining sides function to strengthen the duct. With this arrangement, the duct 4, 5, 5*a* and 5*b* may be in the form of pre-fabricated hollow-profile elements to be inserted as single units or integrated with the feeding reservoir prior to insertion, or also assembled from two parts each inserted in a respective mould 14.

Figure 4B:
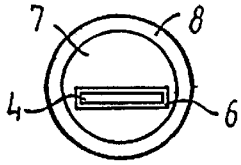

An especially advantageous construction with pre-fabricated ducts 4 can be achieved when the latter are inserted in the feeding reservoir 7, and in the latter or parts thereof constitute the duct walls or duct units in the manner indicated in FIG. 4*b*.

This construction makes it i.a. possible to construct the reservoir 7 with a spherical shape and to let the inlet/downsprue 4 extend transversely through the reservoir whilst maintaining a small Reynolds number with the advantages provided thereby, at the same time as the reservoir 7 has a small surface area and hence a low heat loss due to the spherical or cylindrical shape. Further, in this case, all the duct walls are heated by the reservoir 7, and solidification at the walls during the feeding process is avoided.

When the feeding reservoir 7 and the gauze screen 6 are constructed in the form of an integrated unit, it can advantageously be prefabricated and inserted during the making of the mould 14.

Further, the feeding reservoir 7 can be provided with means for maintaining the pressure and/or for keeping the feeding reservoir 7 under pressure, also when it leaves a pouring station, and such pressure-generating means may e.g. be provided in the manner indicated in applicant's patent application WO 95/18689.

What is claimed is:

1. A method of making an ingate system for feeding a melt to a mold cavity comprising the steps of:

providing a duct through which the melt is conducted to the mold cavity to create a casting therein;

locating a feeding reservoir in communication with the duct prior to the mold cavity which feeds melt to the casting during cooling of the casting; and providing a permeable partition through which the melt must flow when communicating between the duct and the feeding reservoir, the partition offering a finite resistance to melt flow such that the partition functions as a relatively impermeable wall during an initial free flow of the melt to the mold cavity through the duct but as a relatively permeable wall when a back pressure forms in the melt in the duct when the mold cavity is filled and when a drawing pressure forms in the cooling melt in the molding cavity.

2. A method of making an ingate system as claimed in claim 1, and further including the step of forming the permeable partition into a prefabricated duct unit having a hollow profile and placing the prefabricated duct unit in the feeding reservoir to form the duct as well.

3. An ingate system for feeding a melt to fill a mold cavity comprising:

a duct through which the melt is conducted to fill the mold cavity and to create a casting therein, and wherein said duct is a downsprue;

a feeding reservoir in communication with said duct prior to the mold cavity which feeds melt to the casting during cooling of the casting, and wherein said feeding reservoir extends along a side of said downsprue; and a permeable partition means for (a) through which the melt must flow when communicating between said duct and said feeding reservoir, and (b) which offers a finite resistance to melt flow such that said partition functions as a relatively impermeable wall during an initial free flow of the melt to the mold cavity through said duct but as a relatively permeable wall when a back pressure forms in the melt in said duct when the mold cavity is filled and when a drawing pressure forms in the cooling melt in the molding cavity, and wherein said permeable partition is provided in the side of said downsprue.

4. An ingate system as claimed in claim 3, wherein said permeable partition is one of a mesh or gauze screen.

5. An ingate system as claimed in claim 3, and further including a pressure means for applying pressure to said feeding reservoir.

6. An ingate system as claimed in claim 3, wherein said permeable partition is formed into a prefabricated duct unit having a cross-sectional shape which is hollow, said prefabricated duct unit also forming said duct.

7. An ingate system as claimed in claim 3, wherein said feeding reservoir and said permeable partition are integrally formed as a prefabricated unit.

8. An ingate system as claimed in claim 3, wherein said feeding reservoir includes an insulating material thereabout.

9. An ingate system as claimed in claim 8, wherein said duct is insulated from a beginning of said feeding reservoir to the mold cavity.

* * * * *